United States Patent [19]

Linnerz et al.

[11] 4,193,556

[45] Mar. 18, 1980

[54] HAMMER MILL

[75] Inventors: Wilhelm Linnerz, Kaarst; Egbert Hemscheidt, Mülheim, both of Fed. Rep. of Germany

[73] Assignee: Lindemann Maschinenfabrik GmbH, Düsseldorf, Fed. Rep. of Germany

[21] Appl. No.: 884,848

[22] Filed: Mar. 9, 1978

[30] Foreign Application Priority Data

Mar. 25, 1977 [DE] Fed. Rep. of Germany ..... 2713177

[51] Int. Cl.[2] ..... B02C 13/09

[52] U.S. Cl. ..... 241/186 R; 241/189 R

[58] Field of Search ..... 241/186.1, 186.2, 187, 241/189 R, 285 R, 186 R

[56] References Cited

U.S. PATENT DOCUMENTS

| | | | |
|---|---|---|---|
| 2,862,669 | 12/1958 | Rollins | 241/186 R X |
| 3,146,959 | 9/1964 | Putnam | 241/189 R X |
| 3,283,698 | 11/1966 | Williams | 241/186 R X |
| 3,934,499 | 1/1976 | Strom | 241/186 R X |

*Primary Examiner*—Roy Lake
*Assistant Examiner*—Eugene F. Desmond
*Attorney, Agent, or Firm*—Toren, McGeady and Stanger

[57] ABSTRACT

A hammer mill assembly for comminuting scrap material is formed with a housing having a material inlet and a material outlet and a rotor mounted for rotation within the housing including hammer means arranged peripherally of the rotor to effect comminuting action upon rotation of the rotor. A reverberation chamber is defined to extend radially outwardly from the rotor with comminuted scrap material entering the inlet being thrust by the rotor into the reverberating chamber wherein the material is deflected by the walls of the chamber and then directed toward the material outlet, which is covered with a classifying grate. The reverberating chamber has a generally box-like configuration opening radially inwardly toward the rotor with the opening of the reverberating chamber extending substantially from the inlet to the outlet of the housing.

15 Claims, 3 Drawing Figures

HAMMER MILL

BACKGROUND OF THE INVENTION

The present invention relates to apparatus for treating scrap material and more particularly to the construction of a hammer mill designed to comminute such scrap material. The hammer mill to which the present invention relates is of a type consisting of a housing having a material inlet and a material outlet, with the outlet being covered by a classifying grate. A rotor is rotatably supported in the housing with hammer means being spaced peripherally about the rotor to effect comminuting of material when the rotor is rotated. The invention relates to a specific configuration of a hammer mill of the type described.

Hammer mills of this type have been known in the prior art, for example in U.S. Pat. No. 3,482,788. In this prior art device, the material outlet in the housing is covered with a classifying grate which is located at the upper end of a gathering box or discharge chute which extends vertically from the periphery of a rotating rotor which thrusts comminuted material upwardly toward the housing outlet by centrifugal force of the rotor. The openings of the classifying grate at the material outlet allow the material to be emitted therefrom when a particular size compatible with the openings in the grate has been achieved. The grate openings are formed with comparatively large cross-sectional areas in order to prevent clogging of the grate by coarse but relatively light comminuted material.

In the operation of the device disclosed in U.S. Pat. No. 3,482,778, a large portion of the material which is severed from an initial piece of material introduced through the apparatus inlet is thrown or thrust outwardly through the classifying grate without obstruction. A smaller portion of the material is first deflected at or by the grate bars and/or the walls of the gathering box or chute. This portion ultimately falls back on to the rotor to be further comminuted and/or condensed by operation of the hammer mill.

However, experience has shown that apparatus of this type is not well suited for all scrap material. Particularly, when it is desired to comminute scrap material which may, for example, be derived from automobile bodies, it is advantageous to avoid overly rapid discharge of the material. It becomes at times desirable and more economic to effect greater condensation or comminution of the scrap material in order to achieve as small a size as possible for each piece of the scrap material and to thereby achieve a higher bulk density. However, in known hammer mills of the type to which the present invention relates, extension of the time over which the material may be worked within the mill by the rotor in order to effect a greater degree of condensation occurs only to a relatively small degree. For example, in the apparatus of U.S. Pat. No. 3,482,788, the gathering box essentially serves for angular alignment of the scrap pieces so that they may be guided through the classifying grate at the outlet. Additionally, it appears that in known apparatus of this type, the material to be comminuted is dragged or pulled by the hammers of the hammer rotor along the housing bottom between the material inlet and the material outlet, thus causing wear of the housing bottom without performance of a comminuting and/or deforming effect upon the material being treated in the hammer mill.

In the passage of scrap material through various sections of a hammer mill, a significant amount of energy, primarily in the form of kinetic energy expended during passage of the material through its path of travel, may be expended without useful purpose. For example, in the device of U.S. Pat. No. 3,482,788, kinetic energy in the area of the gathering box or in the vicinity of the housing bottom may be expended in the form of friction losses. Thus, as the material travels from material inlet to material outlet through the hammer mill housing, substantial energy which could otherwise be used for the intended purpose of material deformation or comminution, remains unused and is wasted.

The present invention is drawn toward the task of creating a hammer mill of the type discussed above which will better utilize available energy in order to achieve a more uniform size of the material which is to be comminuted and to simultaneously reduce wear in the apparatus. The invention is, thus, directed toward the task of effecting desired condensing and/or comminuting a waste material introduced into a hammer mill with greater effectiveness and improved economy.

SUMMARY OF THE INVENTION

Briefly, the present invention may be described as a hammer mill assembly for comminuting scrap material comprising a housing, a rotor supported within the housing for rotation about a substantially horizontal axis, hammer means on the rotor for comminuting scrap material introduced into the housing, means defining a scrap material inlet and a scrap material outlet for the housing, the inlet and the outlet being spaced from each other circumferentially of the rotor, and wall means defining a reverberation chamber adjacent the periphery of the rotor located between the material inlet and the material outlet taken in the direction of rotation of the rotor with the reverberation chamber being located rearwardly of the scrap material outlet. The reverberation chamber is essentially formed with a box-like configuration opening radially inwardly of the rotor, and the opening of the reverberation chamber may extend across a distance approximating the diameter of the rotor. Scrap material entering the reverberation chamber is caused to ricochet from the walls of the chamber and at least one of the chamber walls is positioned with an angle of inclination tending to defelct scrap particles ricocheting therefrom toward the material outlet of the housing.

Accordingly, the invention is directed toward a solution of the tasks discussed above in that the reverberation chamber is constructed essentially as a deflecting box which opens only toward the hammer rotor with the material outlet being arranged immediately following the reverberation chamber taken in the direction of rotation of the rotor. In this manner, a region is created in the hammer mill in which the kinetic energy imparted to the severed pieces of material by the rotor may be best utilized for deformation and/or further comminution of the scrap pieces by first subjecting all of the material to be comminuted which has been severed at the material inlet to a deflection treatment. Depending upon the brittleness of the material, the material may be further comminuted and freed of adherent impurities. The material, which may for example be sheet metal scraps, is finally condensed to rather small sized pieces approximating the size of an egg or a human fist. Reverberation of the material within the reverberation chamber causes renewed contact of the material pieces with the hammer rotor. The rotor may therefore effect greater condensing and/or comminuting action of the material and may operate to thrust the material through the material outlet by centrifugal force.

Of course, the material outlet may be provided with a classifying grate which will operate to prevent pieces of a size greater than a required minimum size from being passed from the mill.

In accordance with a further development of the invention, it is considered especially advantageous if the material outlet is arranged diametrically opposite to the material inlet relative to the rotor.

In order to achieve more uniform size of the pieces of scrap material being produced, it is considered of further advantage to design the reverberation chamber so that a forward termination point or edge which defines the forwardmost part of the chamber, taken relative to the direction of rotor rotation, is arranged to be spaced a predetermined gap from the striking circle of the hammers of the rotor. The forwardmost wall portion of the reverberation chamber is formed so as to be tapered forwardly of the direction of rotor rotation and it is brought toward the striking circle of the rotor, terminating in the forward termination point of the reverberation chamber which is located a distance short of the striking circle to maintain the aforementioned predetermined gap between the forward termination point and the striking circle. The gap which is maintained is determined by the degree of comminuting effect which is desired at this location to be achieved by operation of the mill. Preferably, the edge which comprises the forward termination point of the reverberation chamber is defined by a replaceable anvil member.

One of the walls defining the reverberation chamber is preferably formed with an angle of inclination which deflects the centrifuged material in a direction toward the aforementioned anvil which is located at the outlet side of the reverberation chamber. Thus, a limiting surface is formed where incoming material is deflected in the direction of rotation of the rotor so that it will insure that the material to be comminuted is not deflected against the direction of rotation of the rotor or against the direction of the flow of material centrifuged into the reverberation chamber by the hammer rotor. The deflection off the wall of the reverberation chamber will thus be in the direction of flow of material and as much as possible in the direction of the material outlet. In this manner, a flow of material is achieved whereby clogging of the apparatus may be minimized or prevented.

In a preferred embodiment of the invention, the material inlet is arranged on one side of the rotor so as to be traversed by the rotor as it moves in an upward direction. Furthermore, the inlet is generally maintained at a horizontal level approximately equivalent to the level of the rotor axis. As a result, there is minimized contact by the flowing material with the bottom of the housing forming the hammer mill. This occurs because the inlet is traversed by the rotor moving in an upward direction with the material thus flowing over the top of the rotor through the reverberation chamber and then to the outlet. Because of the minimized contact with the bottom of the housing, wear which would otherwise occur at this location, and resulting energy losses arising therefrom, are minimized or prevented.

In order to enhance the comminuting effect of the apparatus, the upper edge of the scrap material inlet is brought toward the striking circle of the rotor hammers and terminates in a gap whereby it may be spaced therefrom a predetermined distance in order to effect a desired degree of comminuting at this location. The upper edge of the material inlet may be defined by a replaceable anvil member.

As previously indicated, the reverberation chamber is formed in a generally box-like configuration opening inwardly of the rotor. The opening is advantageously formed to extend generally across the diameter of the rotor from the material inlet to the material outlet. This arrangement will minimize dragging of the material between the inlet and outlet against respective walls of the hammer mill housing which might be caused by the effect of the hammer rotor as it rotates. Because of the specific arrangement of the invention, the material is permitted to be centrifuged as freely as possible against the wall of the reverberation chamber so that the energy imparted to the material at the material inlet will be, as much as possible, usefully transformed into work to perform the condensing and/or comminuting operation. In this arrangement, the upper edge of the material inlet opening forms one of the lower edges of the reverberation chamber. That is, the rearmost termination point of the reverberation chamber will be defined by the same portion of the housing which defines the forwardmost edge of the inlet opening. As previously indicated, this portion may be a replaceable anvil and, as a result, the reverberation chamber is structured to extend immediately adjacent both the material inlet and the material outlet of the housing.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
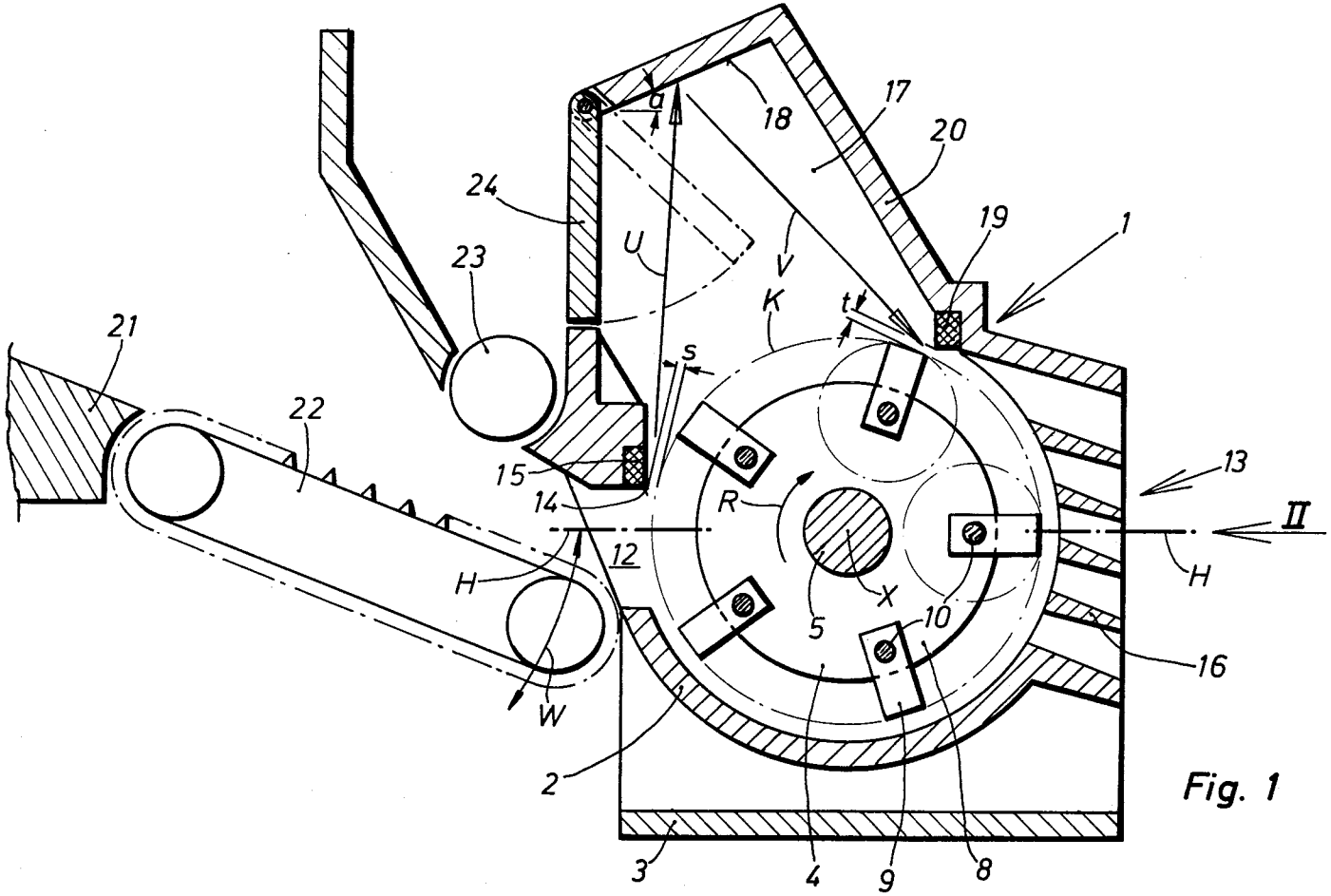
FIG. 1 is a sectional side view of a hammer mill formed in accordance with the present invention taken along the line I—I of FIG. 3.
Figure 2:
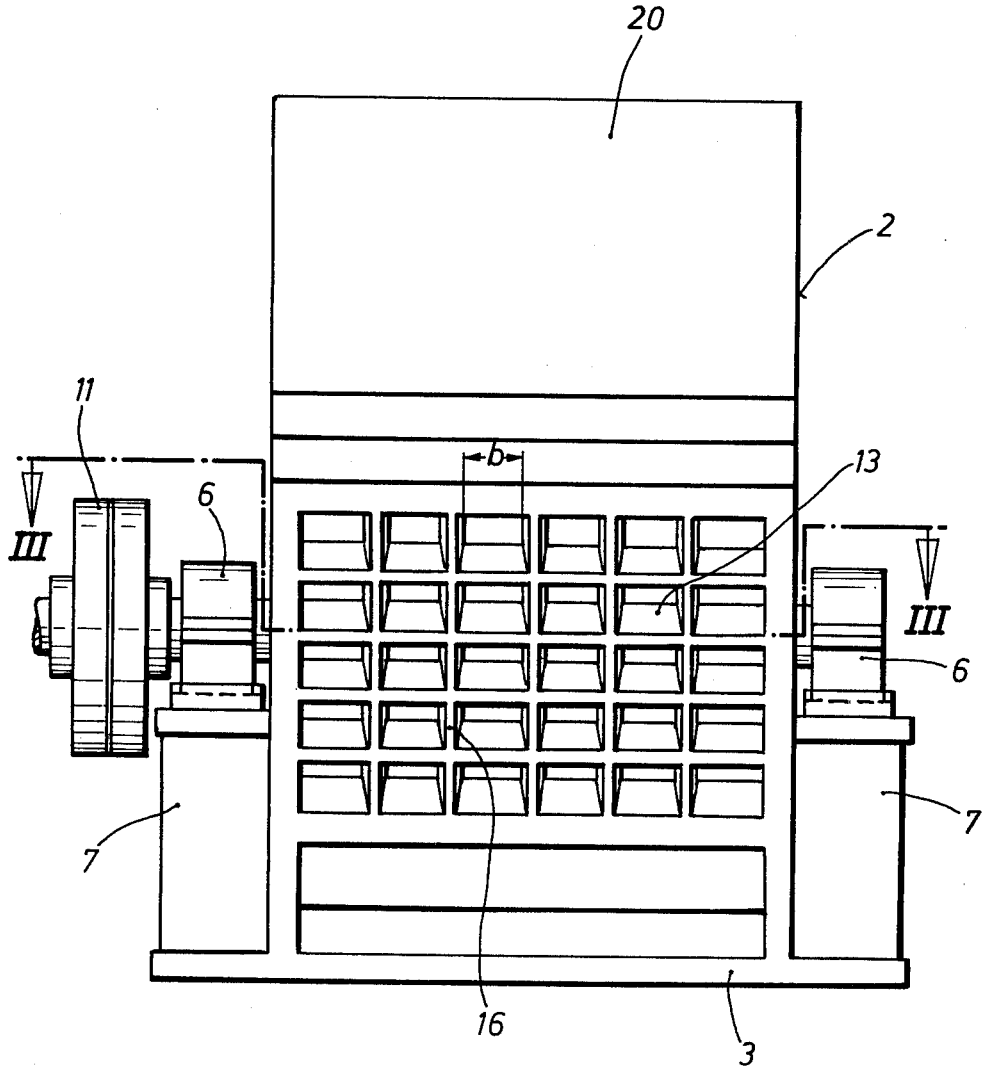
FIG. 2 is an elevational view of the hammer mill according to FIG. 1 taken in the direction of the arow II.
Figure 3:
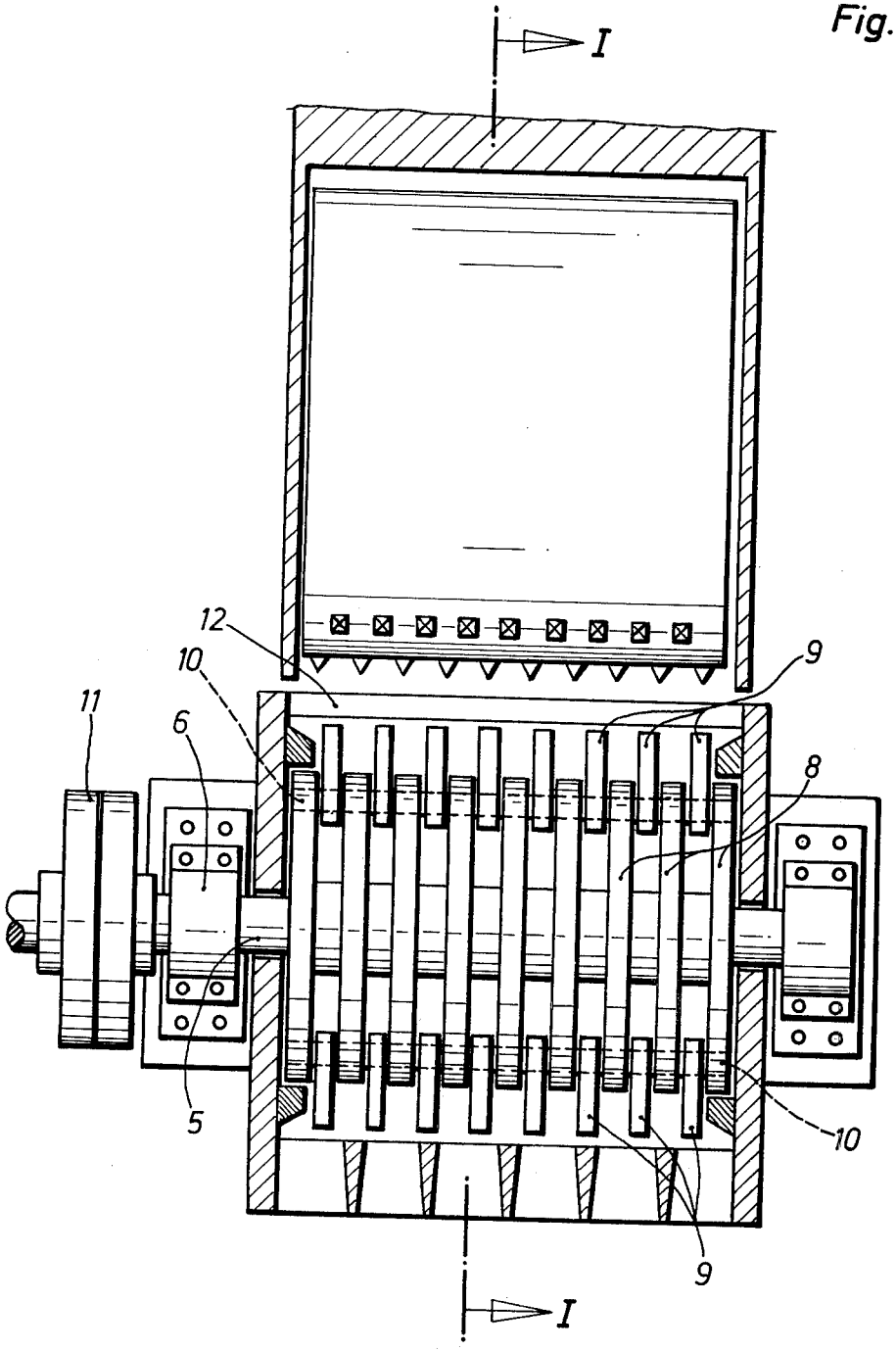
FIG. 3 is a sectional view taken along the line III—III of FIG. 2.

Referring now to the drawings, wherein like reference numerals refer to similar parts throughout the various figures thereof, the present invention is illustrated as embodied in a hammer mill 1 having a housing 2 which is mounted upon a base plate 3. A hammer rotor 4 includes a shaft 5 which is mounted at both ends within the housing 2 by bearings 6. The bearings 6 are mounted on bearing blocks 7 and the rotor 4 is arranged to rotate in a direction R.

The hammer rotor 4 comprises a plurality of rotor disks 8 mounted at spaced locations along the length of the shaft 5. Hammers 9 are pivotally mounted on pivot axes 10 between the rotor disks 8. The pivot axes 10 extend through the rotor disks at a radial location spaced a distance from the shaft 5 and extending parallel thereto. The shaft 5 is connected through a coupling 11 with drive means (not shown) for effecting appropriate rotation of rotor 4.

The housing 2 is formed with a scrap material inlet 12 and a scrap material outlet 13. The material inlet 12 is arranged on the left side of the rotor 4, as seen in FIG. 1. Inasmuch as the rotor 4, as indicated by the arrow R, rotates in a clockwise direction as viewed in FIG. 1, the hammers 9 will be moving in an upward direction as they pass or traverse the material inlet 12. Thus, it will be seen that the inlet 12 is arranged upon a side of the rotor 4 which is moving upwardly when the rotor is in rotation. Furthermore, it should be noted that the rotor axis X is located upon a horizontal plane marked H—H and that the material inlet 12 is also located at approximately the level H—H which is the same horizontal level as the rotor axis X.

The inlet 12 is formed with an upper terminal edge 14 which is defined by a replaceable anvil 15.

The rotor R defines a striking circle K which is the radially outermost point reached by the hammers 9 when the rotor is in rotation. The upper edge 14 of material inlet 12 is brought towards the striking circle K of the hammers and is located to be spaced a gap s from the striking circle K in order to effect a desired degree of comminuting action at this location.

The material outlet 13 is constructed as a classifying grate 16. That is, the material outlet 13 is covered by a classifying grate 16 having openings of a desired size. The outlet 13 is located on the side of the housing 2 opposite the inlet 12. The classifying grate 16 extends in the interior of the housing at a narrow distance parallel to the striking circle K of the rotor. As a result, the classifying grate may be traversed or "passed" by the hammers so that the material cannot clog the grate openings.

In the region between the material inlet 12 and the material outlet 13, the portion of the housing 2 extending above the hammer rotor 4 is constructed to define a reverberating chamber or material deflecting box 17. The chamber 17 is arranged so as to open radially inwardly of the rotor and the height of the chamber 17 is formed to be approximately equivalent to the diameter of the rotor. The side of the opening of the chamber is such that the opening spans across the periphery of the rotor between the material inlet 12 and the material outlet 13.

The chamber 17 is formed with an oblique top wall 18 which is slanted at a particular orientation in order to deflect in the direction of rotation of the rotor material which ricochets therefrom as a result of being thrust against the wall 18 by the centrifugal force of the rotor. The wall 18 is arranged with an angle of inclination a taken relative to the horizontal, with the angle a being preferably selected such that material impinging against the wall 18, which material is moving in the direction of the arrow U, will be deflected approximately in the direction of the arrow V so that the material will once again reach the range of the striking circle of the hammers at the location where the hammers 9 interact with an anvil 19. The anvil 19 is mounted at the lower edge of a side wall 20 which forms the forwardmost wall of the reverberating chamber 17, and the anvil 19 essentially defines the forward terminal point of the chamber 17. As will be noted, the anvil 19 is mounted immediately adjacent the material outlet 13 and the point on the anvil 19 which forms the forwardmost terminal point of the chamber 17 is spaced a distance t from the striking circle K of the hammers. The distance or gap t is determined in accordance with the degree of comminuting which is desired, at least in one dimension, at this location.

As will be seen from FIG. 1, the reverberating chamber 17 has a cross-sectional configuration, taken in a plane entending perpendicularly to the axis of rotation of the rotor, in the shape of a trapezium which is open at the bottom. The size of the pieces of material which are to be comminuted, measured in a direction parallel to the axis of the rotor, will be determined by a width b of the grate openings in the classifying grate 16.

In the operation of the hammer mill of the present invention, when the hammer rotor 4 is rotated in the direction of rotation R, the material which is to be comminuted which may, for example, be bulky refuse such as automobile bodies which are to be scrapped, is delivered on a chute 21 and is forcibly and continuously fed by means of a spiked belt 22 into and through the material inlet 12 to the range of action of the hammer rotor 4. Simultaneously, if necessary, the material may be cross-condensed by means of a roller 23 arranged above the belt 22. The spiked belt 22 is vertically pivotable in the direction of the arrow W.

Using the anvil 15 is a countertool, the hammers 9 will operate to cut or tear pieces of material from an arriving piece of scrap metal which has been introduced into the inlet 12. These pieces by centrifugal action will be thrust in the direction of the arrow U into the reverberating chamber 17 and they will specifically essentially be thrust against the upper oblique wall 18 of the reverberating chamber.

Pieces of material which may be, for example, sheet metal pieces, will be deflected at the wall 18 and deformed thereby resulting in a higher material density while adherent impurities will be loosened. The pieces will be deflected approximately in the direction of the arrow V so that they are again engaged or grasped by the hammers 9 before reaching the second anvil 19.

At the anvil 19 further comminuting effect occurs and the gap t will operate to affect the size of the particles and the comminuting effect which occurs. Subsequently, the comminuted material is thrown or thrust outwardly through the classifying grate 16. Only those pieces of material which exceed one or two dimensions of the width b of the classifying grate openings will be pulled or thrust past the classifying grate 16 by the hammer rotor 4 and these pieces will be again subjected to the aforementioned action of the comminuting tools and the countertools. Massive or large size materials which can not be reduced to at least the size of the grate openings of the classifying grate 16 will become noticeable as a result of the fact that loud noise will occur in the hammer mill. In such a case, the operator may open a discharge door 24 which forms one of the walls of the reverberating chamber 17 and which is mounted as indicated in FIG. 1. The discharge door 24 may be moved to the dotted position shown in FIG. 1 and in this position the door will extend across the main direction of movement U of the material thereby causing the material approaching the discharge door to be deflected outwardly thereof.

While a specific embodiment of the invention has been shown and described in detail to illustrate the application of the inventive pricnciples, it will be understood that the invention may be embodied otherwise without departing from such principles.

What is claimed is:

1. A hammer mill assembly for comminuting scrap material comprising a housing, rotor supported within said housing for rotation about a substantially horizontal axis, hammer means on said rotor for comminuting scrap material in said housing, said hammer means defining during rotation of said rotor a striking circle representing the radially outermost point reached by said hammer means, means defining a scrap material inlet and a scrap material outlet for said housing, and wall means defining a reverberation chamber adjacent the periphery of said rotor, said reverberation chamber being arranged to open inwardly of said rotor and being located with said scrap material outlet arranged immediately forwardly thereof taken in the direction of rotation of the rotor, said reverberation chamber having a forward termination point which is the forwardmost portion of said wall means taken relative to the direction of rotation of said rotor, said forward termination point being spaced a predetermined distance from said striking circle to form a first gap therebetween, said gap being determined in accordance with a degree of comminution of said scrap material desired to be achieved in said hammer mill at said forward termination point, said material inlet being defined with an uppermost termination edge spaced a predetermined second gap from said striking circle of said rotor, said second gap being determined in accordance with a degree of comminution of said scrap material desired to be achieved by said hammer mill at said uppermost termination edge.

2. A hammer mill assembly according to claim 1 wherein said scrap material inlet and said scrap material outlet are located diametrically opposite each other relative to said rotor.

3. A hammer mill assembly according to claim 1 wherein said forward termination point is defined by a replaceable anvil.

4. A hammer mill assembly according to claim 3 wherein said wall means include a deflecting wall extending at an angle of inclination which will cause scrap material impinging said deflecting wall to ricochet therefrom in the general direction of said forward termination point.

5. A hammer mill assembly according to claim 1 wherein the location of said scrap material inlet taken relative to the direction of rotation of said rotor is such that said hammer means are moving in a generally upward direction as they pass said inlet during rotation of said rotor.

6. A hammer mill assembly according to claim 5 wherein said inlet is located at approximately the same horizontal level as the axis of rotation of said rotor.

7. A hammer mill assembly according to claim 1 wherein said upper termination edge is defined by a replaceable anvil.

8. A hammer mill assembly according to claim 1 wherein said upper termination edge also comprises the rearmost termination point of said reverberation chamber, said rearmost termination point being the rearmost portion of said wall means defining said reveraberation chamber taken relative to the direction of rotation of said rotor.

9. A hammer mill assembly according to claim 1 wherein said reverberation chamber opening radially inwardly of said rotor has its opening dimensioned to extend substantially from said scrap material inlet to said scrap material outlet.

10. A hammer mill assembly according to claim 1 wherein the configuration of said reverberation chamber is formed to extend from a generally wider dimension radially inwardly of said rotor to a relatively narrower dimension radially outwardly thereof.

11. A hammer mill assembly according to claim 1 wherein part of said wall means defining said reverberation chamber is pivoted to form a door permitting access to the interior of said reverberation chamber, said door being arranged so that when in an open position it will deflect scrap material being thrust thereagainst by rotation of said rotor outwardly of said chamber.

12. A hammer mill assembly according to claim 1 wherein said reverberation chamber is structured to receive therein scrap material passing through said inlet and engaged by said hammer means of said rotating rotor, said material thus being caused by rotation of said rotor to be thrust to within said reverberation chamber and to reverberate within said chamber, said chamber being generally structured to tend to deflect material therein toward the general direction of movement of said hammer means past said chamber during rotation of said rotor.

13. A hammer mill assembly according to claim 1 wherein said reverberation chamber has an opening which extends across a distance approximately equivalent to the diameter of said rotor.

14. A hammer mill assembly according to claim 1 wherein said reverberation chamber is defined with a height dimension extending generally radially outwardly of said rotor, said height dimension being approximately equivalent to the diameter of said rotor.

15. A hammer will assembly according to claim 1 wherein said scrap material outlet comprises a classifying grate.

* * * * *